US005379987A

United States Patent [19]

Cleary

[11] Patent Number: 5,379,987

[45] Date of Patent: Jan. 10, 1995

[54] ADAPTER FOR A JACKING DEVICE

[76] Inventor: Joseph W. Cleary, 43150 Tyler St., Aguanga, Calif. 92536

[21] Appl. No.: 165,080

[22] Filed: Dec. 9, 1993

[51] Int. Cl.[6] ..... B66F 11/00

[52] U.S. Cl. ..... 254/134; 254/DIG. 4

[58] Field of Search ..... 254/134, 133, DIG. 4, 254/100; 248/357, 300, 247

[56] References Cited

U.S. PATENT DOCUMENTS

| | | | |
|---|---|---|---|
| 1,266,958 | 5/1918 | Kiriyama | 254/DIG. 4 |
| 1,326,670 | 12/1919 | Korzagadarian | 254/133 R |
| 1,522,788 | 1/1925 | Moltz | 254/133 R |
| 1,784,716 | 12/1930 | West | 248/300 |
| 2,215,146 | 9/1940 | Compano | 254/133 R |
| 2,536,550 | 1/1951 | Hughes | 254/133 R |
| 3,300,183 | 1/1967 | Marshall | 254/133 R |
| 3,765,650 | 10/1973 | Eisenhaver | 254/133 R |
| 4,194,726 | 3/1980 | Hance | 254/133 R |
| 4,846,443 | 7/1989 | Collins et al. | 254/133 R |
| 5,131,629 | 7/1992 | Hillhouse | 254/133 R |

*Primary Examiner*—Robert C. Waston

*Attorney, Agent, or Firm*—Macro-Search Corp

[57] ABSTRACT

An adapter apparatus is provided for a jacking device. The adapter comprises a first and second L-shaped portions, each of which provide a first horizontal plate and a first vertical plate. The horizontal plate of the first L-shaped portion provides an engagement rod for engaging a vertical hole in the lifting surface of the jack. As such, the adapter is circumferentially positionable on the jack, and the rod is free to rotate within the vertical hole. The engagement means of the first horizontal plate may include a downwardly extending cylindrical rim for annular engagement with the lifting surface of the jack. A slot may be included in the first horizontal plate for selective positioning of the engagement rod. The second horizontal plate of the second L-shaped portion provides a second lifting surface. The two vertical plates have a selective mutual engagement bolts such that the second lifting surface may be adjustably positionable at a height substantially below the first lifting surface. The two vertical plates may be such that the second lifting surface can be placed below the jack so that the load positioned below the jack may be lifted vertically.

8 Claims, 3 Drawing Sheets

ADAPTER FOR A JACKING DEVICE

FIELD OF THE INVENTION

This invention relates generally to load-lifting jacks and, more particularly, is directed towards an low profile adapter for a jack that allows vertical lifting of a load that is located vertically lower than the jack.

BACKGROUND OF THE INVENTION

Heavy objects, such as mobile home trailers or other vehicles, must often be lifted above the ground in order to access the undersides thereof. Often, however, the lifting surfaces of conventional hydraulic jacks are too high to engaged the lifting area of the vehicle. Particularly with mobile homes, where there is often little or no clearance between the mobile home and the ground, lifting with a conventional jack is nearly impossible. Indeed, one would have to dig a hole under the mobile home large enough to accommodate the jack in order to use such a conventional jack.

So called "low profile" jacks do exist on the market. For example, U.S. Pat. No. 4,964,617 to Lawrence on Oct. 23, 1990, teaches such a device. Such devices are primarily used with vehicles that have about six inches of clearance between the ground and the lifting point of the vehicle. Clearly, however, such devices cannot be used when there is less or no clearance.

An adapter device taught in U.S. Pat. No. 2,469,670 to Thompson on May 10, 1949 does make provision for low ground clearances. Such a devices provides a secondary lifting surface that is located above the ground but below the primary lifting surface of the jack. While such a device is well suited for lifting devices with low clearance, loads that are located below ground level are not able to be lifted by such a device. Further, such a device must be used with a jack that has a particular shape and size. Further, such a device is relatively complicated to manufacture, and therefore tends to be more expensive.

Clearly, then, there is a need for an adapter device that can be readily assembled and engaged with a jack to allow the jack to lift heavy objects that have either low, zero, or negative ground clearance. Such a needed device would be adapted to fit a variety of different but common jacking devices of various sizes. Such a needed device, further, would be relatively inexpensive to manufacture, yet would be strong and extremely durable. Such a needed device, further, could easily be collapsed and stored in a conventional tool box, or the like. The present invention fulfills these needs and provides further related advantages.

SUMMARY OF THE INVENTION

The present invention is an adapter for a jack. The adapter comprises a first and second L-shaped portions, each of which provides a horizontal plate and a vertical plate. The horizontal plate of the first L-shaped portion provides an engagement rod for engaging a vertical hole in the lifting surface of the jack. As such, the adapter is circumferentially positionable on the jack, and the rod is free to rotate within the vertical hole. The engagement means of the first horizontal plate may include a downwardly extending cylindrical rim for annular engagement with the lifting surface of the jack. A slot may be included in the first horizontal plate for selective positioning of the engagement rod. The second horizontal plate of the second L-shaped portion provides a second lifting surface. The two vertical plates have a selective mutual engagement bolts such that the second lifting surface may be adjustably positionable at a height substantially below the first lifting surface. The two vertical plates may be such that the second lifting surface can be placed below the jack so that the load positioned below the jack may be lifted vertically.

The present invention is an adapter device that can be readily assembled and engaged with a jack to allow the jack to lift heavy objects that have either low, zero, or below ground clearance. The present device is adapted to fit a variety of different but common jacking devices of various sizes. Further, the present invention is relatively inexpensive to manufacture, yet is strong and extremely durable. The present device can be easily collapsed and stored in a conventional tool box, or the like. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
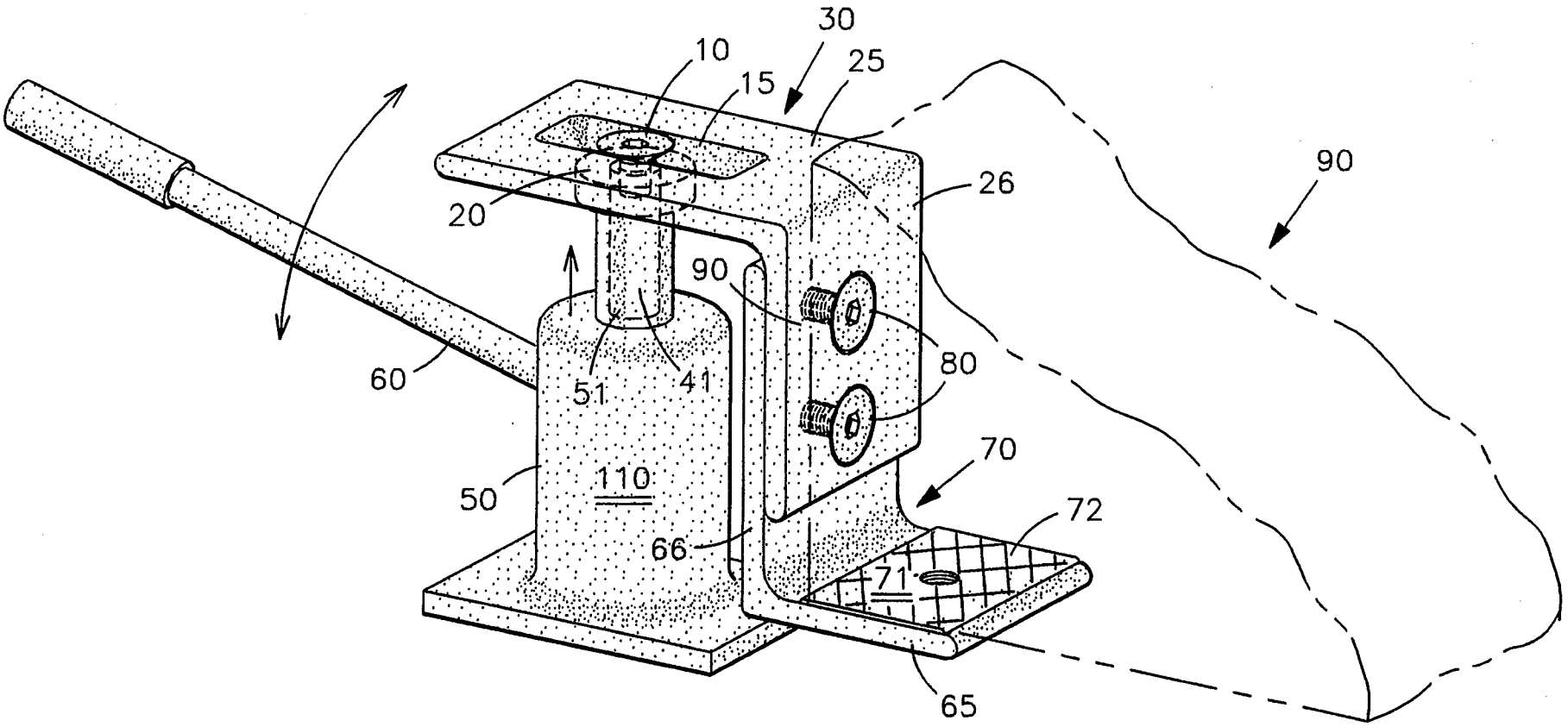
FIG. 1 is a perspective illustration of the invention, showing a load in phantom outline as being lifted by the invention, the invention being engaged with a jacking device.

FIG. 1 shows an adapter for a jacking device 50 of the type that has a first, generally horizontal lifting surface 20 for vertically lifting a load 90. The adapter comprises a first L-shaped portion 30 and a second L-shaped portion 70. The first L-shaped portion 30 provides a first horizontal plate 25 and a first vertical plate 26. The second L-shaped portion 70 provides a second horizontal plate 65 and a second vertical plate 66. The first horizontal plate 25 of the first L-shaped portion 30 provides an engagement means 10, such as a flush-mounted bolt, for engaging the first lifting surface 20 of the jacking device 50. Each L-shaped portion 30,70 is manufactured from a strong, rigid material, such as steel. In one embodiment of the invention, the engagement means 10 of the first horizontal plate 25 includes a rod 41 extending downwardly from the horizontal plate 25 for engagement with a vertical hole 51 in the first lifting surface 20 of the jacking device 50 (FIG.

1). As such, the adapter is circumferentially positionable on the jacking device 50, and the rod 41 is free to rotate within the vertical hole 51. The engagement means 10 of the first horizontal plate 25 may include a downwardly extending cylindrical rim 100 for annular engagement with the first lifting surface 20 (FIG. 2B). A slot 15 may be included in the first horizontal plate 25 for selective positioning of the engagement means 10 (FIG. 1).

Figure 3A:
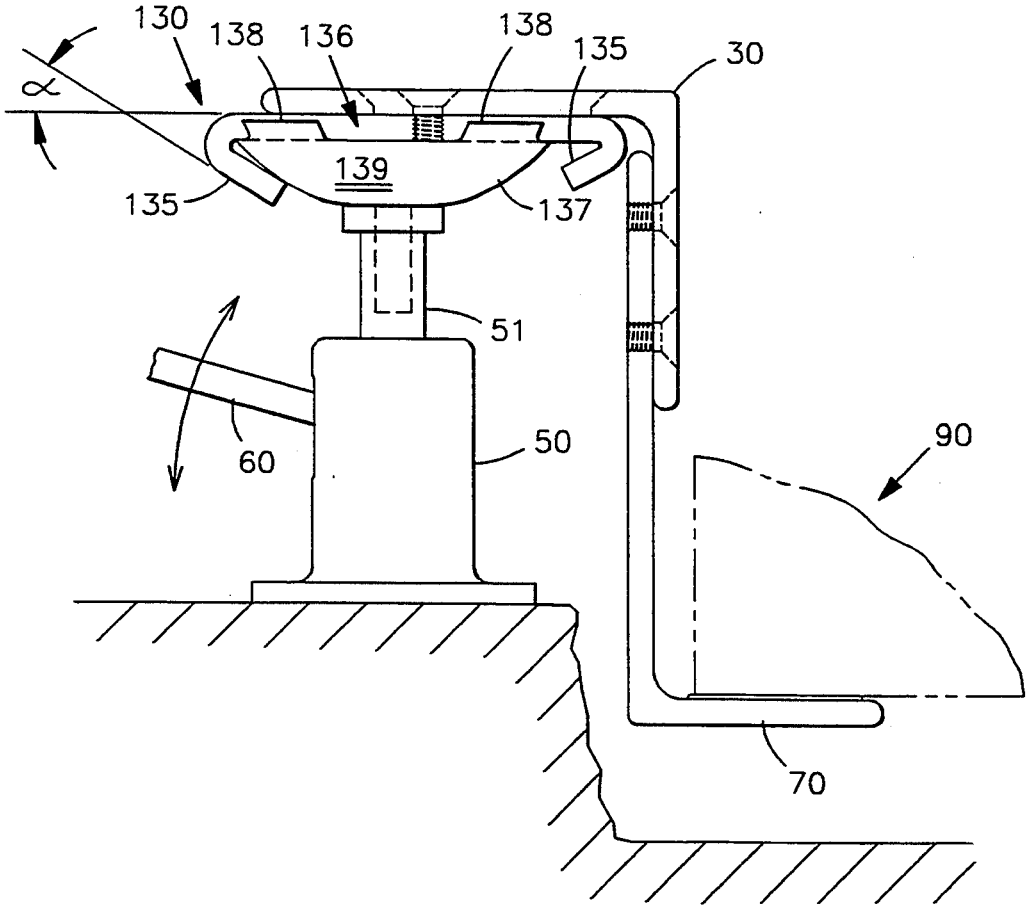
FIG. 3A is a right-side elevational view of the invention, illustrating a jacking device with a cup shaped saddle engaged with the invention, the invention adapted for lifting a load that is located vertically lower than the jacking device.
Figure 3B:
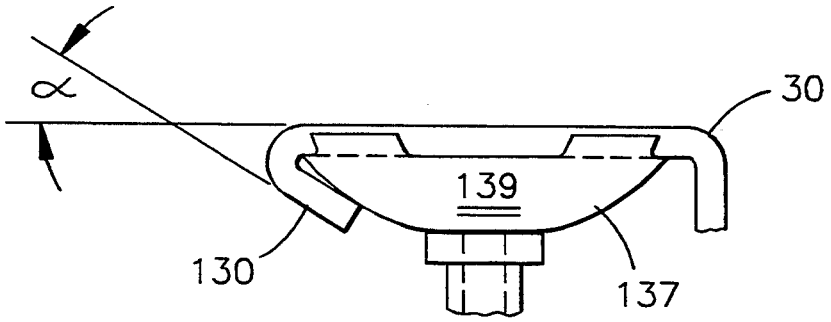
FIG. 3B is a partial right-side elevational view of the invention, illustrating a horizontal plate of a first L-shaped portion with a reverse bent end portion for engaging the cup shaped saddle of the jacking device.

In an alternate embodiment of the invention, the lifting surface 20 of the jacking device 50 consists of a cup shaped saddle 137 having an upward directed rim 136 with engagement finger 138 and a convex shaped downward facing outer surface 139 (FIG. 3B). The engagement means 10 of the first horizontal plate 25 includes a downward, reverse bent end portion 135 of the first horizontal plate 25 that is adapted for conformably fitting around the outer surface 139 of the saddle 137 for engagement therewith. The first horizontal plate 25, in this embodiment, fits between opposing engagement fingers 138 for lateral stability of the adapter on the saddle 137.

Alternatively, the engagement means 10 of the first L-shaped portion 30 includes a first adapter plate 130 for selective engagement with the slot 15 and provides the least one downward, reverse bent end portion 135 that conformably fits around the outer surface 139 of the saddle 137 for engagement therewith (FIG. 3A). The adapter plate 130, in this alternative embodiment, fits between opposing engagement fingers 138 for lateral stability of the adapter on the saddle 137. The at least one downward reverse bent end portion 135 preferably comprises a pair of opposing said portions 135, each forming a unique angle $\alpha$ with the first adapter plate 130. As such, the first adapter plate 130 may be engaged with at least two different sized saddles 137.

Figure 2A:
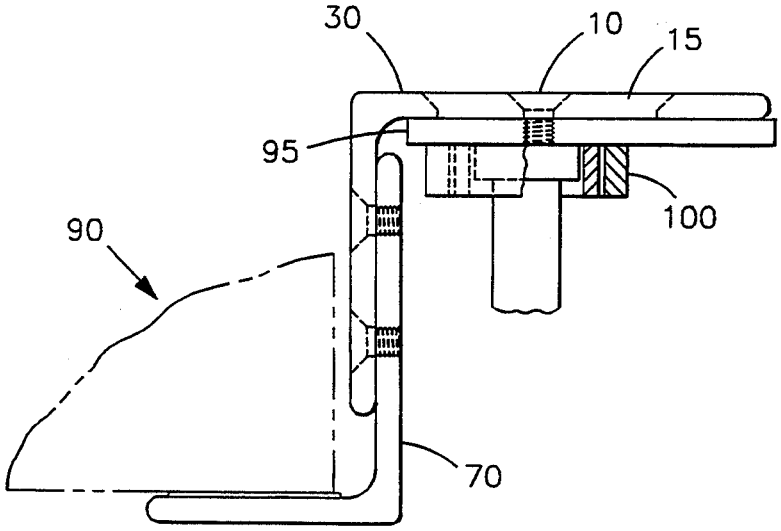
FIG. 2A is a left-side elevational view of the invention, illustrating two L-shaped portions of the invention.
Figure 2B:
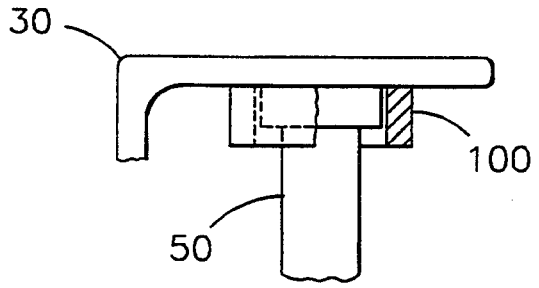
FIG. 2B is a partial left-side elevational view of the invention, illustrating a downwardly extending cylindrical rim of the invention for engaging a lifting surface of the jacking device.

In an alternate embodiment of the invention, the engagement means 10 of the first L-shaped portion 30 includes a second adapter plate 95 for selective engagement with the slot 15 (FIG. 2A). The second adapter plate 95 provides the downwardly extending cylindrical rim 100 for annular engagement with the first lifting surface 20 such that the adapter is circumferentially positionable on the jacking device 50. The cylindrical rim 100 is free to rotate on the lifting surface 20.

The second horizontal plate 65 of the second L-shaped portion 70 provides a second lifting surface 71 (FIG. 1). A pad 72 may be included on the second lifting surface 71 for cushioning the load 90 on the second lifting surface 71, and for preventing the second lifting surface 71 from damaging the surface characteristics of the load 90 that contacts the second lifting surface 71.

The two vertical plates 26,66 have a selective mutual engagement means 80, such as the flush-mounted hex-bolts shown, such that the second lifting surface 71 may be adjustably positionable at a height substantially below the first lifting surface 20. Such a selective mutual engagement means 80 may be such that the second lifting surface 71 may be placed below the jacking device 50 so that the load 90 positioned below the jacking device 50 may be lifted vertically (FIG. 3A). While flush-mounted bolts are illustrated as the mutual engagement means 80, it is to be understood that a wide variety of engagement means 80 may be adapted for suitable use by someone skilled in the art. For example, thumb screw bolts or other bolting means might be used.

In use, the second lifting surface 71 is placed under the load 90 and the engagement means 10 of the first horizontal plate 25 is engaged with the lifting surface 20 of the jacking device 50. If the load 90 is resting on the ground, the second lifting surface 71 can be forced under the load by impacting the second vertical plate 66 with a hammer, or the like, to force the second horizontal plate 65 under the load 90. The second horizontal plate 65 may be formed into a wedge shape (not shown) to facilitate forcing the second horizontal plate 65 under the load 90. The jacking device 50 is then operated in a normal manner, such as by pumping a jacking lever 60 of the jacking device to cause the lifting surface 20 to move vertically upward. Consequently, the second lifting surface 71 is caused to move vertically for lifting the load 90 in response to operation of the jacking device 50. A block of wood or other suitable spacing means (not shown) may be placed between the jacking device and the second vertical plate 66 for maintaining the vertical plates 26,66 in proper vertical alignment.

While the invention has been described with reference to a preferred embodiment, it is to be dearly understood by those skilled in the art that the invention is not limited thereto. Rather, the scope of the invention is to be interpreted only in conjunction with the appended claims.

What is claimed is:

1. An adapter for a jacking device of the type having a first, generally horizontal, lifting surface for lifting a load vertically, the adapter comprising a first, and a second L-shaped portions, each providing a horizontal plate and a vertical plate, the horizontal plate of the first L-shaped portion providing means for engagement with the first lifting surface of the jacking device, the horizontal plate of the second L-shaped portion providing a second lifting surface, the two vertical plates having means for selective mutual engagement such that the second lifting surface is adjustably positionable at a height substantially below the first lifting surface, wherein the means for engagement of the first L-shaped portion includes a rod extending downwardly from the horizontal plate for engagement with a vertical hole in the first lifting surface such that the adapter is angularly positionable on the jacking device, the rod free to rotate within said vertical hole whereby the second lifting surface is caused to move vertically for lifting the load in response to operation of the jacking device.

2. The adapter of claim 1 wherein the lifting surface of the jacking device consists of a cup shaped saddle having an upward directed rim with engagement fingers and a convex shaped downward facing outer surface, the means for engagement of the first L-shaped portion including a downward, reverse bent end portion of the horizontal plate adapted for conformably fitting around the outer surface of the saddle for engagement therewith, the horizontal plate fitting between opposing said engagement fingers for lateral stability of the adapter on the saddle.

3. The adapter of claim 1 wherein the means for engagement of the first L-shaped portion includes a downwardly extending cylindrical rim for annular engagement with the first lifting surface such that the adapter is angularly positionable on the jacking device, the cylindrical rim free to rotate within said vertical hole.

4. The adapter of claim 1 wherein the means for selective mutual engagement of the two vertical plates places the second lifting surface below the jacking device for vertically lifting a load positioned below the jacking device.

5. An adapter for a jacking device of the type having a first, generally horizontal, lifting surface for lifting a load vertically, the adapter comprising a first, and a second L-shaped portions, each providing a horizontal plate and a vertical plate, the horizontal plate of the first L-shaped portion providing a slot for selectively positioning a means for engagement with the first lifting surface of the jacking device, the horizontal plate of the second L-shaped portion providing a second lifting surface, the two vertical plates having means for selective mutual engagement such that the second lifting surface is adjustably positionable at a height substantially below the first lifting surface, wherein the means for engagement of the first L-shaped portion includes a rod fixed to the horizontal plate at a selective position in the slot, and extending downwardly from the horizontal plate for engagement with a vertical hole m the first lifting surface such that the adapter is angularly and circumferentially positionable on the jacking device, the rod free to rotate within said vertical hole whereby the second lifting surface is caused to move vertically for lifting the load in response to operation of the jacking device.

6. The adapter of claim 5 wherein the lifting surface of the jacking device consists of a cup shaped saddle having an upward directed rim with engagement fingers and a convex shaped downward facing outer surface, the means for engagement of the first L-shaped portion including a first adapter plate for selective engagement with the slot and providing at least one downward, reverse bent end portion conformably fitting around the outer surface of the saddle for engagement therewith, the adapter plate fitting between opposing said engagement fingers for lateral stability of the adapter on the saddle.

7. The adapter of claim 6 wherein the at least one downward reverse bent end portion comprises a pair of opposing said portions, each forming a unique angle with the first adapter plate, such that said plate may be engaged with at least two different said saddles.

8. The adapter of claim 5 wherein the means for engagement of the first L-shaped portion includes a second adapter plate for selective engagement with the slot and providing a downwardly extending cylindrical rim for annular engagement with the first lifting surface such that the adapter is angularly and circumferentially positionable on the jacking device, the cylindrical rim being free to rotate on the lifting surface.

* * * * *